US006050424A

United States Patent [19]

Neri et al.

[11] Patent Number: 6,050,424

[45] Date of Patent: Apr. 18, 2000

[54] METHOD OF CHECKING CIGARETTES

[75] Inventors: Armando Neri, Bologna; Mario Turra, Casalecchio Di Reno; Alessio Frontini, Bologna, all of Italy

[73] Assignee: G.D Societa' per Azioni, Bologna, Italy

[21] Appl. No.: 09/021,355

[22] Filed: Feb. 10, 1998

[30] Foreign Application Priority Data

Feb. 11, 1997 [IT] Italy ..... BO97A0057

[51] Int. Cl.[7] ..... B07C 5/00

[52] U.S. Cl. ..... 209/535; 209/643; 131/907

[58] Field of Search ..... 209/535, 536, 209/643, 932; 131/280, 282, 906, 907, 908

[56] References Cited

U.S. PATENT DOCUMENTS

| | | | |
|---|---|---|---|
| 3,616,901 | 11/1971 | Groves | 209/535 |
| 4,592,470 | 6/1986 | Mattei et al. | 131/907 X |
| 5,018,539 | 5/1991 | Gamberini et al. | 209/643 X |
| 5,222,606 | 6/1993 | Ghini et al. | 209/535 |

FOREIGN PATENT DOCUMENTS

| | | | |
|---|---|---|---|
| 0585686 | 3/1994 | European Pat. Off. . | |
| 1186801 | 4/1970 | United Kingdom | 209/535 |
| 2228176 | 8/1990 | United Kingdom . | |
| 2238869 | 6/1991 | United Kingdom . | |

*Primary Examiner*—Tuan N. Nguyen
*Attorney, Agent, or Firm*—Ladas & Parry

[57] ABSTRACT

A method of checking cigarettes, whereby cigarettes are fed in steps along a gravity channel in the outlet of a hopper, and are successively arrested substantially at a checking station where a checking device determines the density of the open ends of the cigarettes and emits at least one control signal indicating the density; and the control signal is optimized by determining the position of the cigarette in the checking station with respect to the checking device.

7 Claims, 4 Drawing Sheets

METHOD OF CHECKING CIGARETTES

BACKGROUND OF THE INVENTION

The present invention relates to a method of checking cigarettes.

The present invention may be used to advantage on the input unit of a cigarette packing machine, to which the following description refers purely by way of example.

Known packing machines normally comprise an input unit featuring an input hopper, the outlet of which is defined by a number of side by side channels for successively feeding superimposed, parallel, horizontal layers of cigarettes to an extracting device moving back and forth through the outlet of the hopper to feed the layers to a device for forming groups of cigarettes.

On some known packing machines, the cigarettes are not checked until after the groups are formed, and any groups comprising even only one faulty cigarette are rejected.

To save economically on the number of cigarettes rejected, U.S. Pat. No. 4,592,470, for example, proposes checking the cigarettes inside the hopper, and rejecting any faulty cigarettes before the groups are formed.

The above method, however, involves several drawbacks, mainly on account of the cigarettes not always being arrested in the same position in front of the checking device. That is, as the cigarettes must be checked and possibly rejected before reaching the extracting device, the checking and extracting devices must be located a given distance apart, so that a column of cigarettes is formed between the two devices, and which varies in height according to humidity, any minor differences in diameter, and the traveling speed of the cigarettes (the faster the cigarettes travel, the more the cigarettes in the column are compressed when arrested). As a result, the cigarettes are not always arrested in the same position in front of the checking device, thus resulting in possible reading errors, and in full cigarettes being rejected or, worse still, partly empty cigarettes being passed.

SUMMARY OF THE INVENTION

It is an object of the present invention to provide a cigarette checking method designed to overcome the aforementioned drawbacks.

According to the present invention, there is provided a method of checking cigarettes, the method comprising the steps of feeding cigarettes, arranged transversely side by side in a column, in a given transverse feed direction and substantially in steps along a gravity channel; successively arresting the cigarettes substantially at a checking station; measuring, at the checking station and by means of a checking device, the density of the open ends of the cigarettes, and emitting at least one control signal indicating the presence or absence of material in front of the checking device; and expelling any faulty cigarettes at a reject station downstream from said checking station; the method being characterized by comprising a detecting step for obtaining position information relative to a position assumed, at the checking station and during the measuring step, by each cigarette with respect to the checking device; and an optimizing step for optimizing said control signal by means of said position information to obtain an optimum signal; a reject signal only being emitted when the optimum signal is below a given threshold value.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
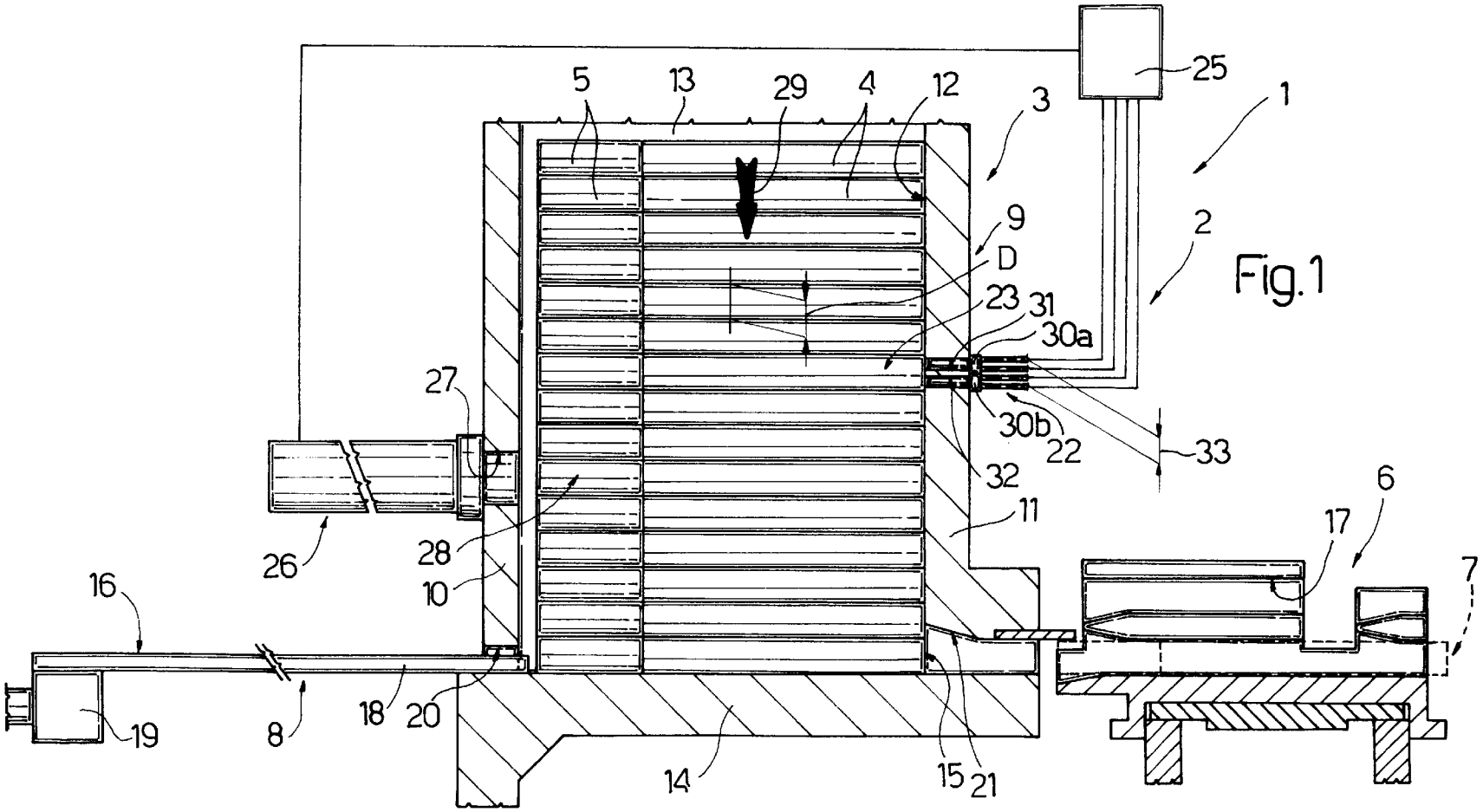
FIG. 1 shows a section of a preferred embodiment of a cigarette supply unit implementing the method according to the present invention.

Numeral 1 in FIG. 1 indicates as a whole a packing machine comprising an input unit 2, in turn comprising an input hopper 3 for a mass (not shown) of cigarettes 4 arranged horizontally and each comprising a filter 5. Unit 2 also comprises a device 6 for forming and conveying groups 7 of cigarettes 4 (only one shown partly in FIGS. 1 and 3), each group 7 comprising a number of cigarettes 4 equal to the number of cigarettes in a packet (not shown); and an extracting device 8 for feeding cigarettes 4 from hopper 3 to device 6.

Hopper 3 comprises at least one outlet 9 defined by a rear wall 10 facing filters 5, and by a vertical front wall 11 parallel to wall 10 and defining, with wall 10, a cavity of a width approximately equal to but no smaller than the length of cigarettes 4. The cavity is divided into a number of elementary channels 12 (only one shown) by partitions or dividing walls 13 (only one shown in FIGS. 1 and 3) separated by a distance approximately equal to but no less than the diameter of cigarettes 4.

Channels 12 are defined at the bottom by a horizontal plate 14 for supporting cigarettes 4, which are arranged in columns along respective channels 12 to define a number of superimposed horizontal layers 15, each of which, on contacting plate 14, is engaged by a pusher 16 forming part of extracting device 8, and is expelled from hopper 3, in a direction parallel to the longitudinal axis of cigarettes 4, into a respective cavity 17 of device 6.

Figure 3:
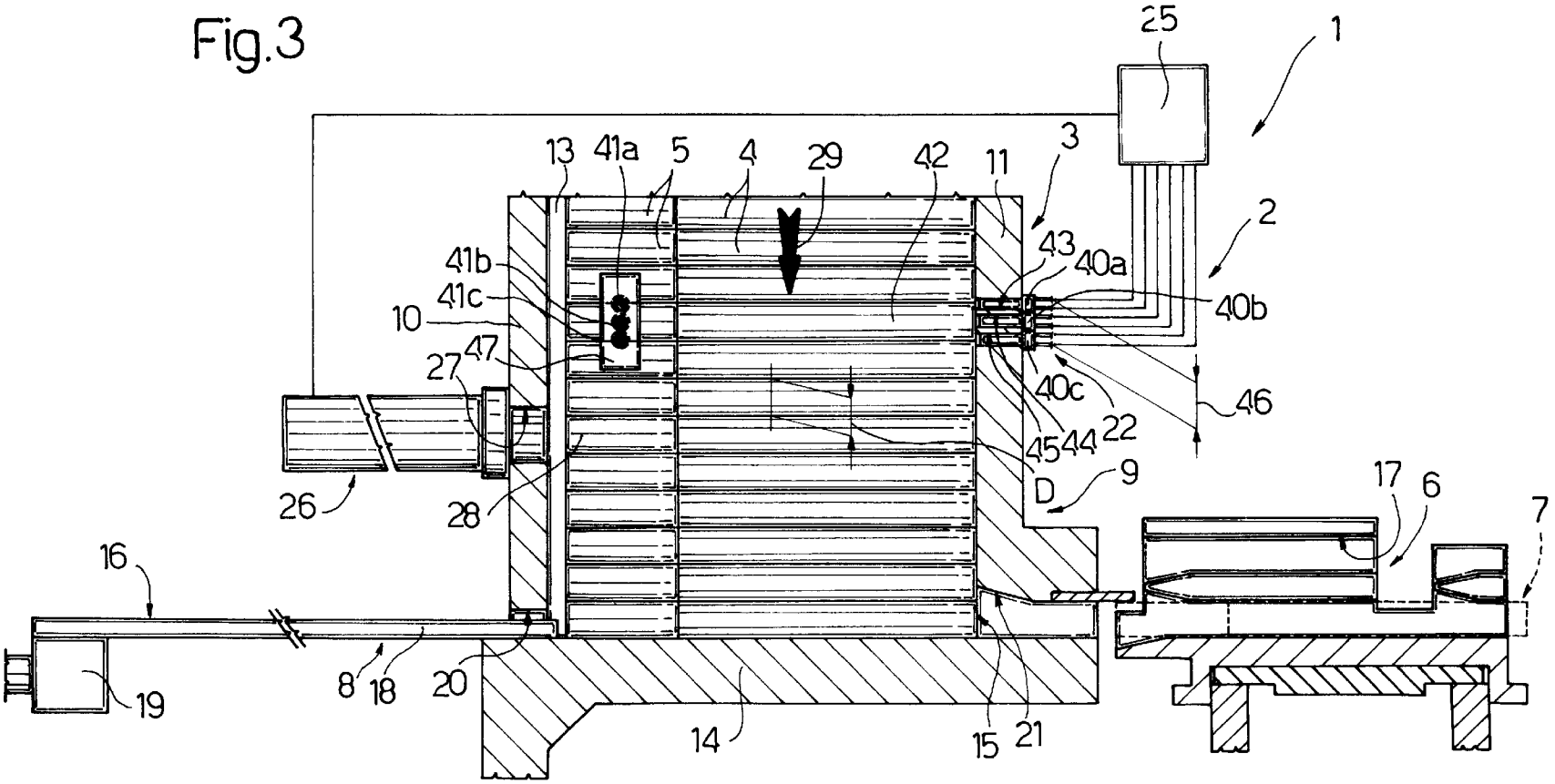
FIG. 3 shows a variation of FIG. 1.

As shown in FIGS. 1 and 3, pusher 16 comprises an expulsion element defined by a flat plate 18 fitted contacting the top surface of plate 14, and which is slid along plate 14 by an actuating member 19 forming part of extracting device 8. Plate 18 is of a width approximately equal to but no smaller than the width of a layer 15, is of a thickness substantially equal to the radius of cigarettes 4, and is movable back and forth, through walls 10 and 11, between a forward work position and a withdrawn rest position. In the work position, plate 18 engages two through openings 20 and 21 in walls 10 and 11 to feed cigarettes 4 of a layer 15 into a cavity 17; and, in the rest position, plate 18 rests on plate 14, outside hopper 3 and behind rear wall 10 of the hopper. Accordingly, the cigarettes 4 in the layer 15 descend in steps as the extracting device undergoes reciprocal movement back and forth.

Detailed descriptions of the structure of hopper 3, extracting device 8, and device 6 are to be found in British Patents n. 1,298,785 and 2,023,994.

A checking device 22 is mounted along each channel 12, to the front of wall 11 at a checking station 23, to check each of cigarettes 4 traveling in steps along channel 12, to determine the substantially exact position of the cigarette 4— hereinafter indicated 4*a*— facing device 22, and to emit a signal 24 indicating the position and density of cigarette 4*a*. More specifically, device 22 emits a number of signals indicating the density of cigarette 4*a* arrested at station 23, and, as a function of the position of cigarette 4*a* at station 23, selects an optimum signal 24 best indicating the density of cigarette 4*a*.

The optimum signal 24 is supplied to a central unit 25 controlling a known reject device 26 for pneumatically extracting any faulty cigarettes 4 from hopper 3 through a hole 27 formed in wall 10 of outlet 9 at a reject station 28 downstream from checking station 23 in the traveling direction 29 of cigarettes 4 towards plate 14.

In the embodiment in FIG. 1 example, device 22 comprises two optical sensors 30*a*, 30*b*, which are housed inside respective holes 31, 32 in wall 11, are positioned facing the free ends of cigarettes 4, are aligned with each other in direction 29, and are arranged at a distance 33 from each other, measured in direction 29, at most equal to the diameter "D" of cigarettes 4.

Each sensor 30*a*, 30*b* emits a cyclic signal 24*a*, 24*b* timed by the travel of cigarettes 4, i.e. by extracting device 8; and the value of signal 24*a*, 24*b*, which depends on the mass facing sensor 30*a*, 30*b*, varies according to whether sensor 30*a*, 30*b* directly faces a peripheral edge 34 or a central portion 35 of the free end of cigarette 4*a*, and according to the density of the free end of cigarette 4*a*. Central portion 35 is a free end portion close to the longitudinal axis 36 of cigarette 4*a*, and edge 34 is defined by a free end portion at the cylindrical surface 37 of cigarette 4*a*.

Figure 2:
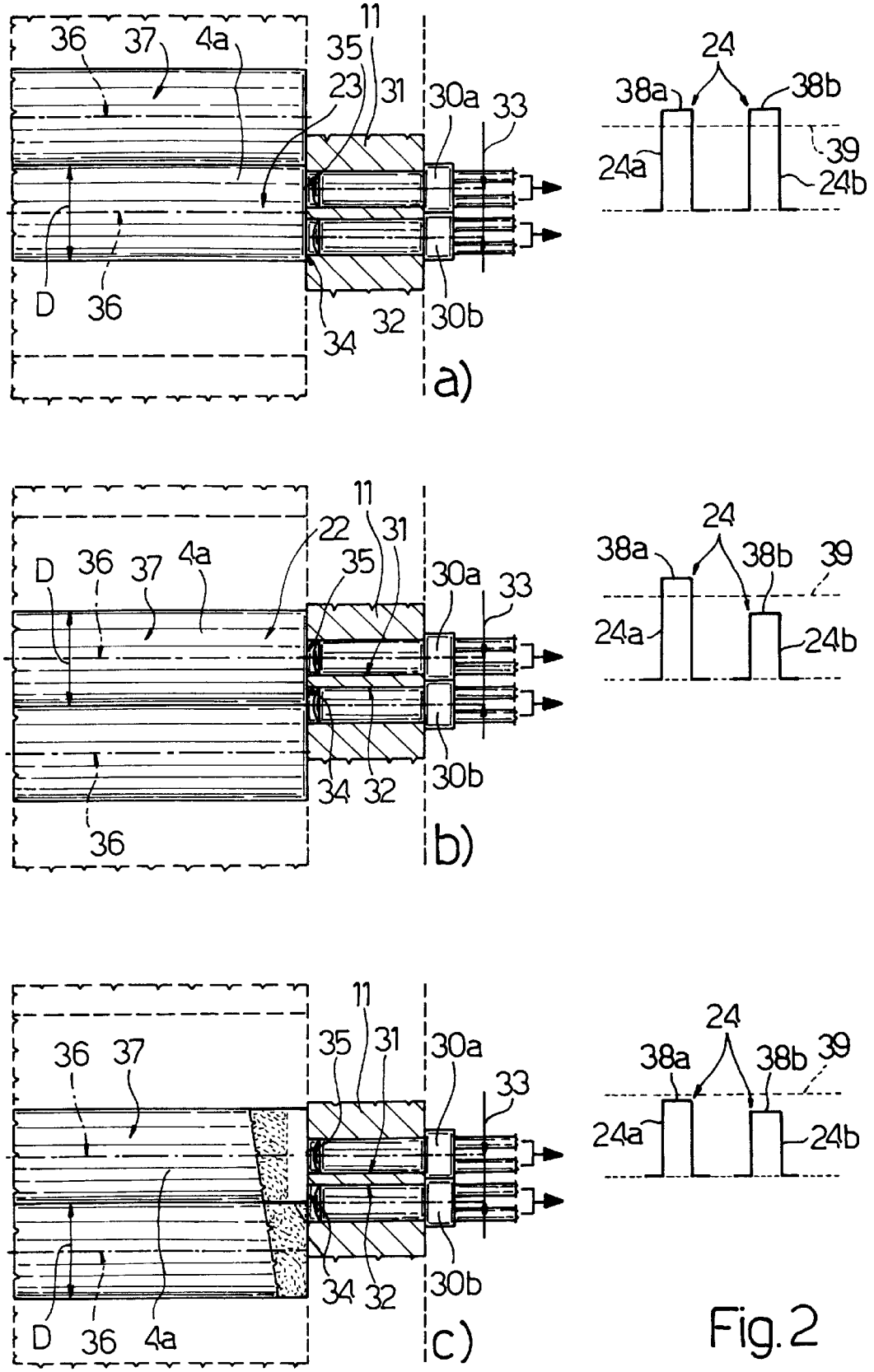
FIG. 2 shows a detail of FIG. 1 in three possible operating configurations.

In FIG. 2*a*, both sensors 30*a*, 30*b* face central portion 35 of the free end of the same cigarette 4*a* of sufficient density, so that signals 24*a*, 24*b* emitted by respective sensors 30*a*, 30*b* assume respective maximum values 38*a*, 38*b* above a given threshold value 39 by which to accurately select said optimum signal 24. In the FIG. 2*a* case, either of signals 24*a*, 24*b* may therefore be selected as optimum signal 24.

In FIG. 2*b*, sensor 30*a* faces central portion 35 of a cigarette 4*a* of sufficient density, and sensor 30*b* faces edge 34 of the same cigarette 4*a*, where cigarette 4*a* substantially rests on the downstream cigarette 4 in channel 12. Sensor 30*a* therefore emits a signal 24*a* of a maximum value 38*a* above threshold value 39, and sensor 30*b* a signal 24*b* of a maximum value 38*b* below threshold value 39, so that, in this case, only signal 24*a* may be selected as optimum signal 24.

In FIG. 2*c*, sensor 30*a* faces central portion 35 of a cigarette 4*a* of insufficient density, and sensor 30*b* faces edge 34 of the same cigarette 4*a*. The maximum values 38*a*, 38*b* of signals 24*a*, 24*b* are therefore both below threshold value 39, so that, in this case, either of signals 24*a*, 24*b* may be selected as optimum signal 24.

In actual use, and with reference to one channel 12, cigarettes 4 are fed in a column and substantially in steps along channel 12 as each cigarette 4 on plate 14 is expelled by extracting device 8, so that each cigarette 4 is fed through and arrested for a short time at checking station 23. Sensors 30*a*, 30*b*, which are activated in time with each step of cigarettes 4, emit respective cyclic signals 24*a*, 24*b*, each indicating the mass facing respective sensor 30*a*, 30*b*; and signals 24*a*, 24*b* are supplied to central unit 25, which performs an optimizing operation whereby the maximum values 38*a*, 38*b* of signals 24*a*, 24*b* are compared with threshold value 39.

When both values 38*a*, 38*b* are above threshold value 39, as in FIG. 2*a*, this means the cigarette 4*a* at the checking station is positioned correctly with respect to both sensors 30*a*, 30*b* and is of sufficient density, so that, as stated, either of signals 24*a*, 24*b* may be selected as optimum signal 24, which, being above threshold value 39, does not activate reject device 26.

When, as in FIG. 2*b*, either one of signals 24*a*, 24*b* assumes a value (in this case 38*a*) above threshold value 39, this means the cigarette 4*a* at checking station 23 is only positioned correctly with respect to sensor 30*a*, the signal 24*a* of which is therefore selected as optimum signal 24 and does not activate reject device 26.

When the maximum values 38*a*, 38*b* of both signals 24*a*, 24*b* are below threshold value 39, as in FIG. 2*c*, the position of cigarette 4*a* may be interpreted in two ways: both sensors 30*a*, 30*b* may be positioned facing central portion 35 of the free end of a cigarette 4*a* of insufficient density; or, as in FIG. 2*c*, only sensor 30*a* is positioned facing central portion 35 of a cigarette 4*a* of insufficient density, and sensor 30*b* is positioned facing edge 34 of the same cigarette 4*a*. Whichever the case, when maximum values 38*a*, 38*b* are both below threshold value 39, either of signals 24*a*, 24*b* may be selected as optimum signal 24, which causes central unit 25 to emit a signal activating reject device 26 to expel the faulty cigarette 4 on reaching reject station 28.

Figure 4:
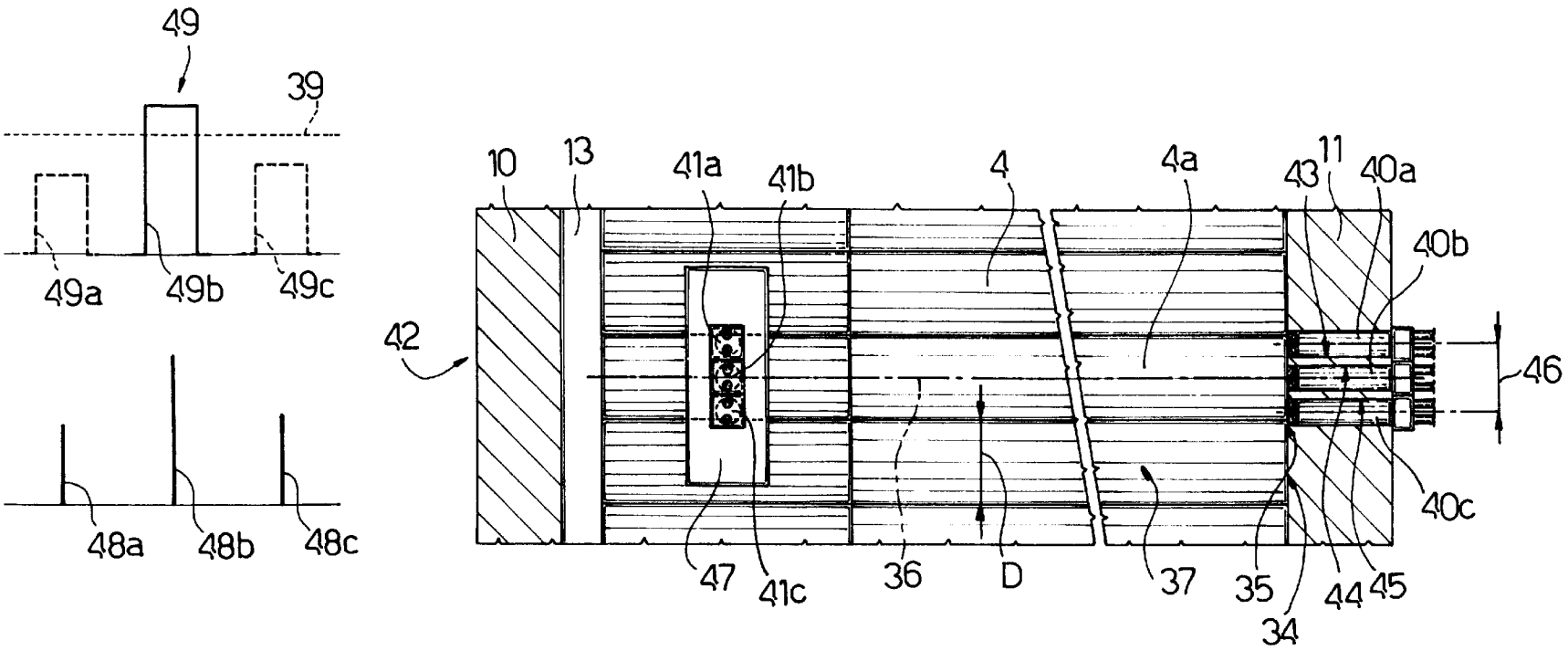
FIG. 4 shows a detail of FIG. 3.

In the FIGS. 3 and 4 variation, checking device 22 comprises three optical sensors 40*a*, 40*b*, 40*c* for detecting the density of the free ends of cigarettes 4, and three sensors 41*a*, 41*b*, 41*c* for detecting the position of the cigarettes with respect to sensors 40*a*, 40*b*, 40*c* at a checking station 42. Sensors 40*a*, 40*b*, 40*c* are housed inside respective holes 43, 44, 45 in wall 11, are positioned facing the free ends of cigarettes 4, are aligned with one another in direction 29, and are equally spaced over a distance 46 less than the diameter "D" of cigarettes 4. The projection of distance 46 in a direction perpendicular to direction 29 defines the extension of checking station 42 through which cigarettes 4 are fed one at a time. Each position sensor 41*a*, 41*b*, 41*c* is fitted to a plate 47 in turn fitted to partition 13 (not shown), and is aligned with a respective sensor 40*a*, 40*b*, 40*c* in a direction perpendicular to direction 29.

In actual use, and with reference to FIG. 4, when a cigarette 4*a* is arrested in checking station 42, position sensors 41*a*, 41*b*, 41*c* emit respective signals 48*a*, 48*b*, 48*c* indicating the presence of a cigarette in station 42, and the value of each of which increases in proportion to how close the axis 36 of cigarette 4*a* is to the respective sensor 41*a*, 41*b*, 41*c*. As sensors 41*a*, 41*b*, 41*c* are equally spaced over distance 46, one of them emits a higher signal than the other two—in FIG. 4, the highest signal is signal 48*b* emitted by sensor 41*b*.

At the same time, sensors 40*a*, 40*b*, 40*c* emit respective signals 49*a*, 49*b*, 49*c* indicating the mass of material in the respective portions of station 23 facing the sensors.

Central unit 25 performs an optimizing operation by selecting an optimum signal 49 among the signals emitted by sensors 40*a*, 40*b* and 40*c*. The optimum signal 49 is emitted by whichever of sensors 40*a*, 40*b*, 40*c* is aligned with the sensor 41*a*, 41*b*, 41*c* emitting the highest of signals 48*a*, 48*b* and 48*c*. This may be done by central unit 25 either activating all three sensors 40*a*, 40*b*, 40*c* and only using the signal 49*a*, 49*b*, 49*c* corresponding to the highest of signals 48*a*, 48*b*, 48*c*, or by only activating the sensor 40*a*, 40*b*, 40*c* aligned with the sensor 41*a*, 41*b*, 41*c* emitting the highest of signals 48*a*, 48*b*, 48*c*. The selected optimum signal 49 is compared by central unit 25 with threshold value 39, and, if the signal value is below threshold value 39, central unit 25 emits a reject signal to expel the faulty cigarette 4 on reaching reject station 28.

What is claimed is:

1. A method of checking cigarettes, the method comprising the steps of feeding cigarettes (4), arranged transversely side by side in a column, in a given transverse feed direction (29) and substantially in steps along a gravity channel (12);

successively arresting the cigarettes (4) in said channel (12) so that the cigarettes in said column are successively positioned, substantially at a checking station (23; 42); measuring, at the checking station and by means of a checking device (22), the density of the open ends of the cigarettes (4), and emitting at least one control signal (24*a*, 24*b*; 49*a*, 49*b*, 49*c*) indicating the presence or absence of material in front of the checking device (22); expelling any faulty cigarettes at a reject station (28) downstream from said checking station (23; 42); the method further comprising a detecting step for obtaining position information relative to a position assumed, at the checking station (23; 42) and during the measuring step, by each cigarette (4) with respect to the checking device (22); and an optimizing step for optimizing said control signal (24*a*, 24*b*; 49*a*, 49*b*, 49*c*) by means of said position information to obtain an optimum signal (24; 49); a reject signal only being emitted when the optimum signal (24; 49) is below a given threshold value (39) said position detecting step being performed by means of at least two position sensors (30*a*, 30*b*; 41*a*, 41*b*, 41*c*) arranged over a distance (33; 46), measured in said feed direction (29), at most equal to a mean diameter (D) of a cigarette (4).

2. A method as claimed in claim 1, wherein the checking device (22) comprises at least two control sensors (30*a*, 30*b*; 40*a*, 40*b*, 40*c*), each aligned with a respective position sensor (30*a*, 30*b*; 41*a*, 41*b*, 41*c*) in a direction perpendicular to said feed direction (29).

3. A method as claimed in claim 2, wherein the position sensors (30*a*, 30*b*) are defined by the control sensors (30*a*, 30*b*).

4. A method as claimed in claim 3, wherein said optimizing step is performed by mutually comparing the control signals (24*a*, 24*b*) emitted by said sensors (30*a*, 30*b*) to determine the highest control signal; a reject signal only being emitted when said highest control signal is below said given threshold value (39).

5. A method as claimed in claim 3, wherein said two control sensors (30*a*, 30*b*) are arranged over a distance (33), measured in said feed direction (29), substantially equal to a mean radius of a cigarette (4).

6. A method as claimed in claim 2, wherein each position sensor (41*a*, 41*b*, 41*c*) emits a cyclic position signal (48*a*, 48*b*, 48*c*) synchronized with each feed step and indicating the position of a cigarette (4) with respect to the position sensors (41*a*, 41*b*, 41*c*); said optimizing step being performed by determining the highest position signal (48*a*, 48*b*, 48*c*) for each cycle corresponding to each feed step; and activating the control sensor (40*a*, 40*b*, 40*c*) aligned with the position sensor (41*a*, 41*b*, 41*c*) emitting the highest position signal (48*a*, 48*b*, 48*c*).

7. A method as claimed in claim 2, wherein each position sensor (41*a*, 41*b*, 41*c*) emits a cyclic position signal synchronized with each feed step and indicating the position of a cigarette (4) with respect to the position sensors (41*a*, 41*b*, 41*c*); said optimizing step being performed by determining, for each cycle corresponding to each feed step, the position sensor (41*a*, 41*b*, 41*c*) emitting the highest position signal (48*a*, 48*b*, 48*c*); activating all the control sensors (40*a*, 40*b*, 40*c*) to obtain respective control signals (49*a*, 49*b*, 49*c*); and rejecting all the control signals (49*a*, 49*b*, 49*c*) except for the one (49) emitted by the control sensor (40*a*, 40*b*, 40*c*) aligned with the position sensor (41*a*, 41*b*, 41*c*) emitting the highest position signal (48*a*, 48*b*, 48*c*).

* * * * *